US009293246B1

(12) United States Patent
Folker et al.

(10) Patent No.: US 9,293,246 B1
(45) Date of Patent: Mar. 22, 2016

(54) MAGNETIC COMPONENT WITH INTEGRATED COMPONENT CIRCUIT BOARD

(71) Applicant: Universal Lighting Technologies, Inc., Madison, AL (US)

(72) Inventors: Donald Folker, Madison, AL (US); David Blevins, Madison, AL (US); Thomas Poehlman, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/033,741

(22) Filed: Sep. 23, 2013

Related U.S. Application Data

(60) Provisional application No. 61/708,378, filed on Oct. 1, 2012.

(51) Int. Cl.
*H01F 27/29* (2006.01)
*H01F 27/30* (2006.01)

(52) U.S. Cl.
CPC ..... *H01F 27/29* (2013.01)

(58) Field of Classification Search
CPC ..... H01F 5/02; H01F 27/06; H01F 27/29; H01F 27/325; H01F 27/362; H01F 27/365; H01F 27/36; H01F 27/292
USPC ..... 336/198, 208, 192, 212
See application file for complete search history.

(56) References Cited

U.S. PATENT DOCUMENTS

| | | | | |
|---|---|---|---|---|
| 7,498,921 | B1 * | 3/2009 | Wang | 336/200 |
| 7,990,243 | B1 * | 8/2011 | Folker et al. | 336/192 |
| 8,116,089 | B1 * | 2/2012 | Folker et al. | 361/760 |
| 8,619,432 | B2 * | 12/2013 | Baska et al. | 361/773 |
| 2004/0119575 | A1 * | 6/2004 | Steiner | 336/208 |
| 2013/0249659 | A1 * | 9/2013 | Tseng et al. | 336/65 |

* cited by examiner

*Primary Examiner* — Mangtin Lian
(74) *Attorney, Agent, or Firm* — Patterson Intellectual Property Law, P.C.; Mark J. Patterson; Grant M. Ford

(57) ABSTRACT

A component printed circuit board is provided between a magnetic component and a main printed circuit board. The magnetic component includes a device such as an inductor or transformer and includes a bobbin for winding one or more coils and a magnetically permeable core. Terminal pins protrude from the bobbin toward the main printed circuit board and provide electrical connection between the magnetic component and the main printed circuit board. The component printed circuit board includes component vias positioned to accept one or more of the terminal pins allowing the terminal pins to be used for electrical connection to both the component printed circuit board and the main printed circuit board. One or more component traces or shielding layers are disposed on the component printed circuit board. Each component trace provides an electrical connection between two or more terminal pins passing through the component printed circuit board.

20 Claims, 6 Drawing Sheets

MAGNETIC COMPONENT WITH INTEGRATED COMPONENT CIRCUIT BOARD

CROSS-REFERENCES TO RELATED APPLICATIONS

This application claims benefit of and priority to U.S. Provisional patent application No. 61/708,378 filed Oct. 1, 2012 entitled "Magnetic Component with Integrated Multipurpose Printed Circuit Board" all of which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to magnetic devices for electronic circuits, and more particularly to devices such as inductors and transformers for mounting on circuit boards.

Conventional magnetic devices such as inductors and transformers typically include one or more conductive windings positioned about a bobbin or other winding mandrel. The windings may include primary and secondary windings in a transformer and one or more windings in an inductor. Magnetic devices of this nature are generally constructed with one or more terminal pins configured to be inserted through corresponding terminal holes, or vias, in a printed circuit board. The terminal pins project outwardly from a bobbin structure in many conventional configurations. The conductive windings positioned on the bobbin are electrically connected to the terminal pins such that the windings may be electrically coupled to electrical circuit traces on the printed circuit board after installation of the magnetic device on the circuit board. Each terminal pin generally extends through a via, or hole, in the circuit board; and a soldered connection is established using conventional soldering techniques.

In many circuit applications, it is desirable for one or more terminal pins on a bobbin to be electrically interconnected to other terminal pins protruding from the same bobbin. Conventional configurations for achieving electrical interconnection of terminal pins on a magnetic device bobbin typically include either providing jumper or crossover wires on the bobbin itself or providing one or more jumper or crossover traces on the main printed circuit board upon which the magnetic device is mounted. Such jumper wires may be used to connect pins on the same bobbin rail, or may be used as crossover connections to connect pins on opposing bobbin rails. The conventional solution of placing one or more jumper or crossover wires between pins on the bobbin structure itself is cost and labor intensive. Jumper and crossover wires of this nature may also become dislodged or may become damaged during installation and use. Additionally, thermal, RF or magnetic effects near external jumper and crossover wires on the bobbin may reduce performance of the device.

The second conventional solution of placing jumper or crossover traces on the main printed circuit board for electrically connecting bobbin terminal pins also has problems. For example, a printed jumper or crossover trace configuration is typically unique to a particular application for a specific circuit performance objective associated with a specific magnetic component. When a printed circuit board is configured with a printed jumper or crossover trace configuration for a specific bobbin terminal pin interconnection layout, the main circuit board is generally only operable for use with that particular magnetic device configuration for that specific circuit performance objective. The unique jumper or crossover trace configuration on the main printed circuit board limits the interchangeability of the main printed circuit board and prevents the main printed circuit board from being used with other transformers. Once a main printed circuit board is printed with a specific jumper or crossover trace configuration for connecting bobbin terminal pins, the jumper or crossover trace configuration is fixed. As a result, multiple circuits that may have similar features except for the bobbin pin jumper or crossover trace configuration require numerous different main printed circuit board layouts and require numerous boards to be printed with each unique jumper or crossover trace configuration to work with different magnetic components.

What is needed then are improvements in magnetic components to allow improved jumper and crossover connections.

BRIEF SUMMARY OF THE INVENTION

The present invention provides a magnetic component having a component circuit board coupled to terminal pins protruding from a bobbin on the component. The component circuit board may be located between the magnetic component bobbin and the main printed circuit board on which the magnetic component is to be mounted. The component circuit board may include one or more jumper or crossover traces for electrically interconnecting bobbin terminal pins. Alternatively, the component printed circuit board includes one or more shielding layers or one or more grounding connections.

In some embodiments, the present invention provides a magnetic component apparatus for mounting on a main printed circuit board. The apparatus includes a bobbin and first and second terminal pins protruding from the bobbin. A component printed circuit board is mounted on the first and second bobbin pins. The component printed circuit board is configured to fit between the bobbin and the main printed circuit board. The first and second terminal pins each provide electrical connection between the component printed circuit board and the main printed circuit board.

In additional embodiments, the present invention provides a magnetic component apparatus for mounting on a main printed circuit board. The apparatus includes a bobbin and first and second terminal pins protruding from the bobbin. A component printed circuit board is disposed on the first and second terminal pins, and the first and second terminal pins protrude through the component printed circuit board extending in a direction away from the bobbin. A component trace is disposed on the component printed circuit board electrically connecting the first and second terminal pins. In some embodiments, the component trace is a jumper trace. In other embodiments, the component trace is a crossover trace.

An object of the present invention is to provide a magnetic component having a component printed circuit board having a shielding layer disposed thereon.

A further object of the present invention is to provide a magnetic component having a component printed circuit board having a grounding connector disposed thereon.

Yet another object of the present invention is to provide a magnetic component configured to mount on a main printed circuit board with a component printed circuit board positioned between the main printed circuit board and the magnetic component.

An additional object of the present invention is to provide a trace on the component printed circuit board that can be used as a crossover from one of the magnetic pin rails on the bobbin to a pin rail on the other side of the bobbin. This allows for a crossover that is external to the magnetic component which makes the construction of the magnetic component easier and less expensive.

A further object of the present invention is to provide a trace on the component printed circuit board that can be used as a jumper for the main printed circuit board. This saves room on the main printed circuit board and allows for a low profile jumper. The jumper can be useful in relieving printed circuit board layout problems.

A further object of the present invention is to provide circuitry on the component printed circuit board such that the component printed circuit board can be used as a daughter card for the main printed circuit board, thereby increasing the power density of the device.

Yet another object of the present invention is to provide a component printed circuit board with circuitry between a magnetic component and a main printed circuit board to reduce the need for the main printed circuit board to be a double-sided printed circuit board.

Numerous other objects, advantages and features of the present invention will be readily apparent to those of skill in the art upon a review of the following drawings and description of a preferred embodiment.

DETAILED DESCRIPTION

Figure 1:
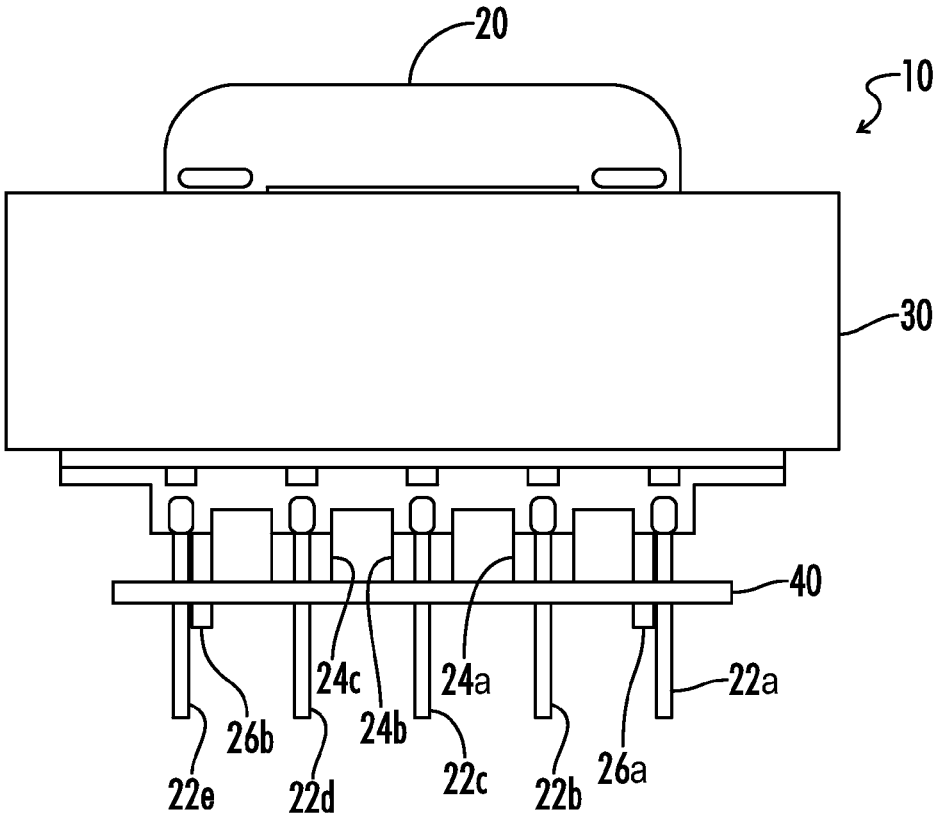
FIG. 1 illustrates an end elevation view of an embodiment of a magnetic component with integrated component printed circuit board.
Figure 2:
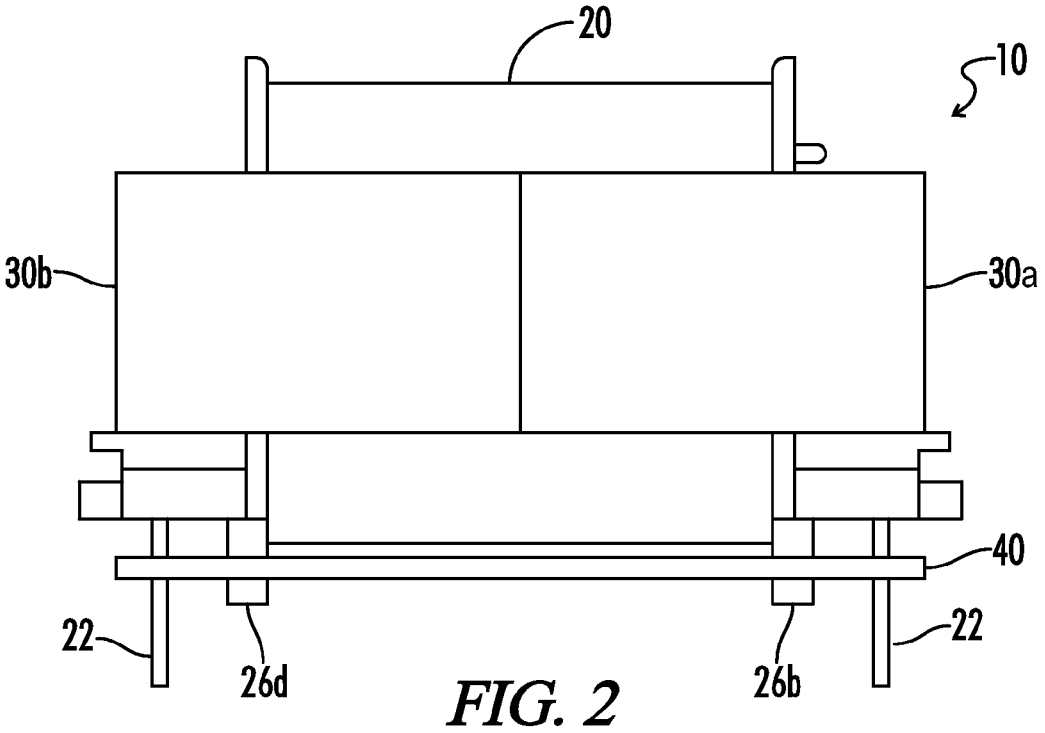
FIG. 2 illustrates a side elevation view of the embodiment of a magnetic component with integrated component printed circuit board of FIG. 1.

Referring now to the drawings, numerous embodiments of magnetic components with integrated component printed circuit boards are generally illustrated. Although exemplary embodiments are shown in the drawings, the invention may take many forms and is in no way limited to the particular embodiments shown in the drawings and described below.

Figure 3:
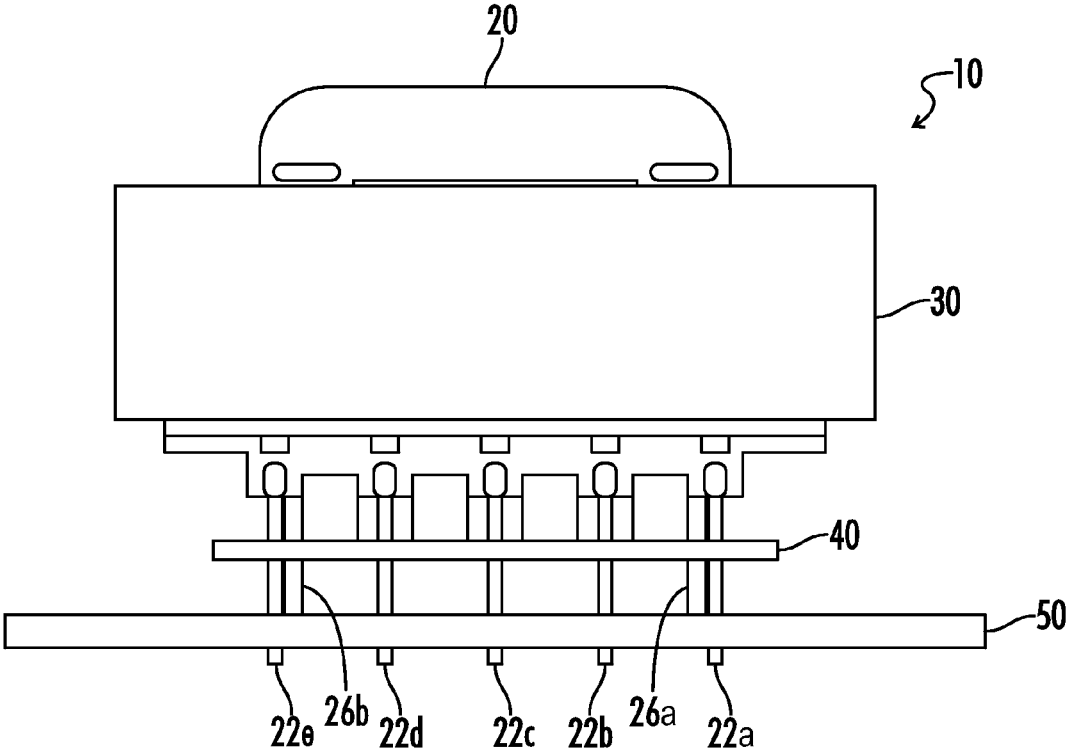
FIG. 3 illustrates an end elevation view of an embodiment of a magnetic component with integrated component printed circuit board installed on a main printed circuit board.
Figure 4:
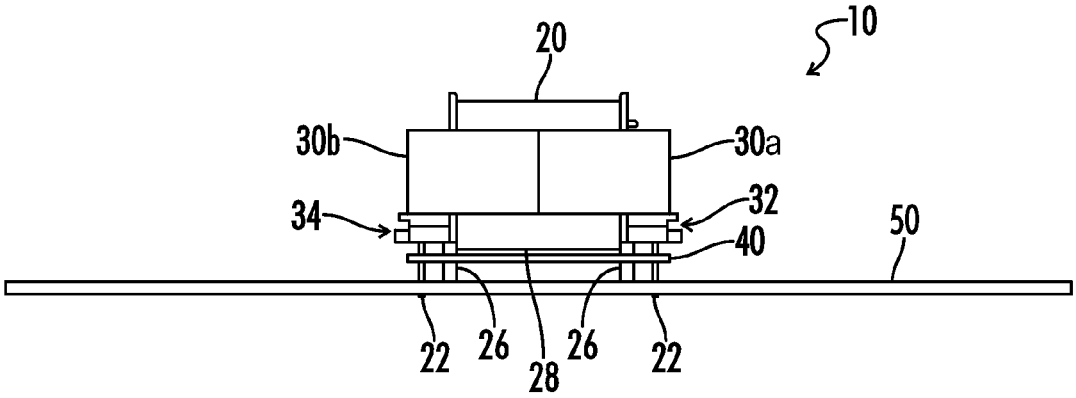
FIG. 4 illustrates a side elevation view of the embodiment of a magnetic component with integrated component printed circuit board installed on a main printed circuit board of FIG. 3.
Figure 5:
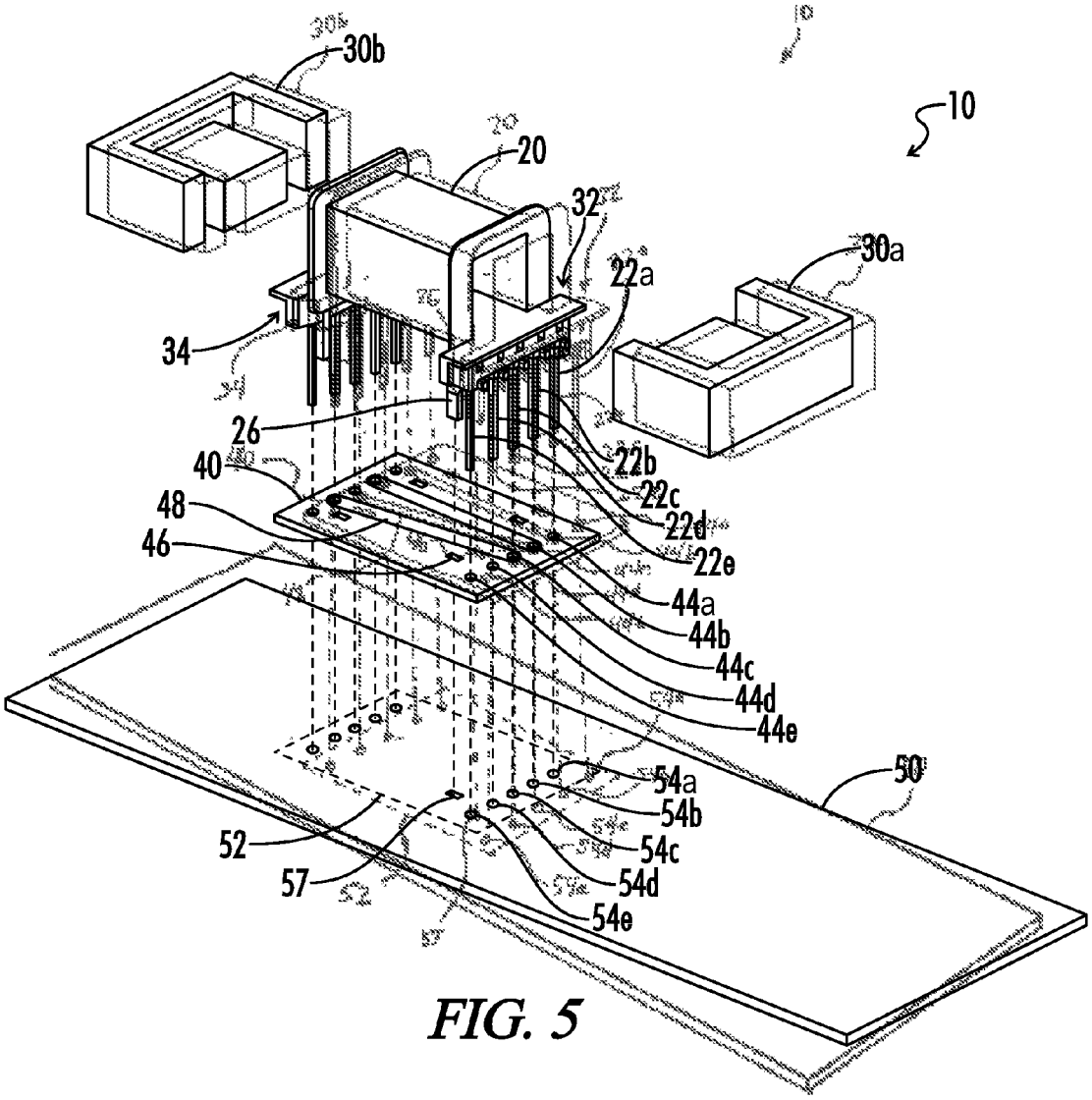
FIG. 5 illustrates a partially exploded perspective view of an embodiment of a magnetic component with integrated component printed circuit board positioned for installation on a main printed circuit board.

A magnetic component with integrated component printed circuit board is shown in FIG. 1 and is generally designated by numeral 10. A magnetic component with integrated component printed circuit board 10 may alternatively be described simply as magnetic component 10. As seen in FIGS. 1-5, magnetic component 10 includes a bobbin 20 and one or more magnetically permeable core structures 30. Each core structure 30 is mounted on bobbin 20. One or more conductive windings are positioned on bobbin 20 to form coils. Bobbin 20 in some embodiments includes primary and secondary winding coils forming a transformer. Bobbin 20 may also include only one winding coil, or more than two winding coils, in various embodiments of inductors and transformers. Bobbin 20 also includes an axial passage through which a portion of core 30 extends. In some embodiments, as seen in FIG. 5, core structure 30 includes first and second E-core halves 30*a*, 30*b*. In alternative embodiments not shown, core 30 may include other suitable core shapes known in the art.

Referring further to FIGS. 1-5, bobbin 20 includes a plurality of terminal pins 22*a*, 22*b*, etc. . . . protruding from bobbin 20. Each terminal pin 22 includes an electrically conductive wire material such as copper. Each terminal pin 22 is generally configured for connection to an electronic circuit on a main printed circuit board on which magnetic component 10 is to be installed. For example, in some embodiments, magnetic component 10 includes an inductor or a transformer configured for mounting on a main printed circuit board. Upon mounting the transformer on the main printed circuit board, each terminal pin 22 is soldered or otherwise joined to corresponding electrical leads on the main printed circuit board to provide electrical connectivity between one or more circuits on the main printed circuit board and the magnetic component 10. Terminal pins 22 on bobbin 20 protrude from first and second bobbin rails 32, 34 (FIG. 4) in some embodiments.

A component printed circuit board 40 is mounted on the terminal pins 22 protruding from the bobbin 20 in some embodiments. Component printed circuit board 40 is generally configured to fit between bobbin 20 and main printed circuit board 50, as seen in FIGS. 3-5. Component printed circuit board 40 may be or include a single or double sided printed circuit board in various embodiments. Component printed circuit board 40 includes a plurality of component vias 44, or component through-holes, each shaped and positioned to accommodate passage of a corresponding terminal pin 22 extending from bobbin 20. For example, as seen in FIG. 5, a first terminal pin 22*a* extends through a corresponding first component via 44*a* defined in component printed circuit board 40. A second terminal pin 22*b* extends through a corresponding second component via 44*b* defined in component printed circuit board 40. A third terminal pin 22*c* extends through a corresponding second component via 44*c* defined in component printed circuit board 40. A fourth terminal pin 22*d* extends through a corresponding fourth component via 44*d* defined in component printed circuit board 40. A fifth terminal pin 22*e* extends through a corresponding fifth component via 44*e* defined in component printed circuit board 40. Numerous other component vias may be defined in component printed circuit board 40 to allow passage of additional terminal pins protruding from bobbin 20.

When the component printed circuit board 40 is installed on the bobbin 20, and more specifically on terminal pins 22, component printed circuit board 40 rests against one or more component standoffs 24*a*, 24*b*, 24*c* projecting from the surface of bobbin 20. Each component standoff 24 provides a structure against which component printed circuit board 40 may rest, providing a controlled spacing between component printed circuit board 40 and the lower edge 28 of bobbin 20, which may include one or more windings or other electrical circuit components that would otherwise interfere with component printed circuit board.

Referring further to FIGS. 1-5, in some embodiments, bobbin 20 includes one or more main standoffs 26*a*, 26*b*, 26*c*, 26*d* protruding from the bobbin 20 toward the direction of the main printed circuit board 50. Each main standoff 26 in some embodiments extends substantially parallel to the terminal pins 22. Main standoff 26 extends through a main standoff socket 46 defined in component printed circuit board 40. After passing through the main standoff socket 46, main standoff 26 extends downwardly from component printed circuit board 40 and engages the surface of main printed circuit board 50 at a main standoff engagement location 57. As such, the main standoff 46 supports bobbin 20 above main printed circuit board 50. Component standoff 26 extends from bobbin 20 a shorter distance than main standoff 26, allowing component printed circuit board 40 to be positioned above the main printed circuit board 50 without touching either the main body of bobbin 20 and also without touching main printed circuit board 50.

Additionally, in some embodiments, at least two terminal pins extend entirely through component printed circuit board 40 such that the terminal pins protrude from the other side of the component printed circuit board 40 in a direction away from bobbin 20. As such, the free terminal pin ends projecting away from component printed circuit board 40 are available for further connection to main printed circuit board 50. For example, as seen in FIGS. 3-4, terminal pins 22 extend through component printed circuit board 40 and contact main printed circuit board 50. At the junction of terminal pins 22 and main printed circuit board 50, the terminal pins 22 are electrically connected to one or more circuits on main printed circuit board 50 by a conventional connection techniques such as through hole mounting and soldering or surface mounting.

In some embodiments, as seen in FIG. 5, main printed circuit board 50 includes a plurality of main vias 54*a*, 54*b*, etc. Each main via 54 is shaped and positioned to receive a corresponding terminal pin 22. For example, a first terminal pin 22*a* protrudes from bobbin 30, passes through first component via 44*a*, and further extends into first main via 54*a* on main printed circuit board 50. Similarly, a second terminal pin 22*b* protrudes from bobbin 20, passes through second component via 44*b*, and further extends into second main via 54*b* on main printed circuit board 50. A third terminal pin 22*c* protrudes from bobbin 20, passes through third component via 44*c*, and further extends into third main via 54*c* on main printed circuit board 50. A fourth terminal pin 22*d* protrudes from bobbin 20, passes through fourth component via 44*d*, and further extends into fourth main via 54*d* on main printed circuit board 50. A fifth terminal pin 22*e* protrudes from bobbin 20, passes through fifth component via 44*e*, and further extends into fifth main via 54*e* on main printed circuit board 50. Numerous other bobbin pins 22 may pass through corresponding component vias 44 on component printed circuit board 40 and extend into corresponding main vias 54 on main printed circuit board 50.

In some embodiments, each terminal pin 22 passing through component printed circuit board 40 and joining main printed circuit board 50 is available to provide an electrical connection between the bobbin 20, the component printed circuit board 40, and/or the main printed circuit board 50. Additionally, the component printed circuit board 40 allows electrical connections between different terminal pins 22. In many applications, it is generally desirable to interconnect two or more terminal pins on a bobbin-wound magnetic component. Using conventional techniques, the connections among different terminal pins are achieved using either jumper or crossover wires or jumper or crossover traces disposed on the main printed circuit board between main vias 54. The component printed circuit board 40 alleviates the need for additional jumper or crossover wires or printed jumper or crossover traces on the main printed circuit board 50, as the jumper paths can be printed directly on the component printed circuit board 40. This can be advantageous in many applications, as an integrated component printed circuit board disposed on the bobbin 20 using terminal pins 22 reduces the need for additional jumper or crossover circuitry to be installed on the main printed circuit board.

Figure 7:
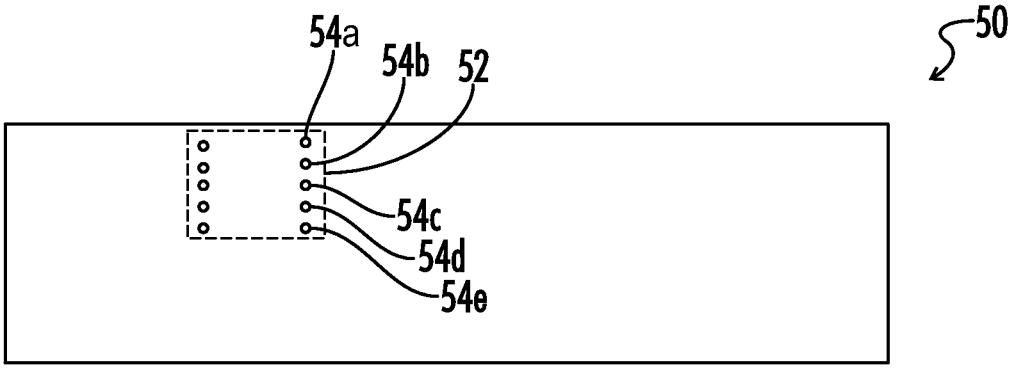
FIG. 7 illustrates a plan view of an embodiment of a main printed circuit board including a clear magnetic component mounting area without main jumper or crossover traces.

As seen in FIG. 5, the main printed circuit board 50 includes a magnetic component mounting location 52. The main vias 54 are generally defined in the main printed circuit board 50 at the magnetic component mounting location 52 to accommodate terminal pins 22 when magnetic component 10 is mounted on main printed circuit board 50. By providing a component printed circuit board 40 between main printed circuit board 50 and bobbin 20, jumper and/or crossover traces can be left off the main printed circuit board at the magnetic component mounting location 52, as seen in FIG. 7, thereby simplifying main PCB layout. In some applications, this allows one main printed circuit board 50 having a common circuit configuration to be used interchangeably with different magnetic components 10 that may require different jumper and/or crossover trace configurations. For example, a first magnetic component requiring a first trace configuration can be combined with a suitable component printed circuit board 40 having the unique trace configuration corresponding to that particular magnetic component. That assembly can be installed on a common main printed circuit board having a clear magnetic component mounting location 52. The same common main printed circuit board 50 may also accept a second magnetic component 10 requiring a different trace configuration by installing an appropriate component printed circuit board 40 having that unique trace configuration between the second magnetic component 10 and the main printed circuit board 50.

Figure 6:
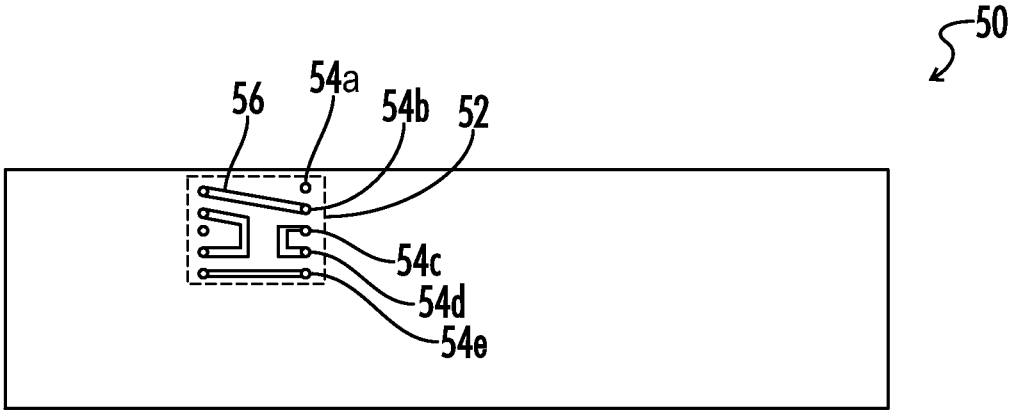
FIG. 6 illustrates a plan view of an embodiment of a main printed circuit board including a magnetic component mounting area with main jumper and crossover traces.

In other applications, as seen in FIG. 6, it may be desirable to include a component printed circuit board 40 on a magnetic component 10 and also to include jumper and/or crossover traces on the magnetic component mounting location 52 on the main printed circuit board 50. The use of circuitry and/or jumper or crossover traces on the component printed circuit board 40 provides greater flexibility in arranging the traces in magnetic component mounting location 52 on main printed circuit board 50, as seen in FIG. 6.

Figure 8:
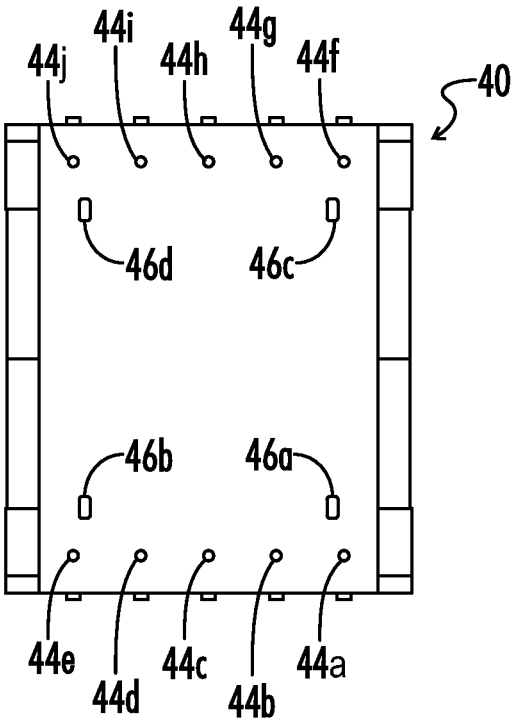
FIG. 8 illustrates a plan view of an embodiment of a component printed circuit board.

Various embodiments of jumper and/or crossover trace configurations for component printed circuit board 40 are shown in FIGS. 8-15. Component printed circuit board 40 may be configured to include one or more jumper and/or crossover traces electrically connecting any component vias 44. A jumper trace is generally defined as a trace interconnecting two or more terminal pins protruding from the same bobbin rail or same bobbin side. A crossover trace is generally defined as a trace interconnecting two or more terminal pins protruding from opposite bobbin rails. In some embodiments, as seen in FIG. 8, component printed circuit board 40 includes five component vias 44*a*, 44*b*, 44*c*, 44*d*, 44*e* associated with terminal pins protruding from first bobbin rail 32. Component printed circuit board 40 also includes five component vias 44*f*, 44*g*, 44*h*, 44*i*, 44*j* associated with terminal pins protruding from second bobbin rail 34. Each component via 44 corresponds to a location of a terminal pin 22 protruding from bobbin 20. Although component vias 44 are shown as being oriented either on the right or left side of component printed circuit board 40 associated with bobbin pin rail locations, the component vias 44 may alternatively be positioned at any suitable location corresponding to a location of a terminal pin 22.

Figure 9:
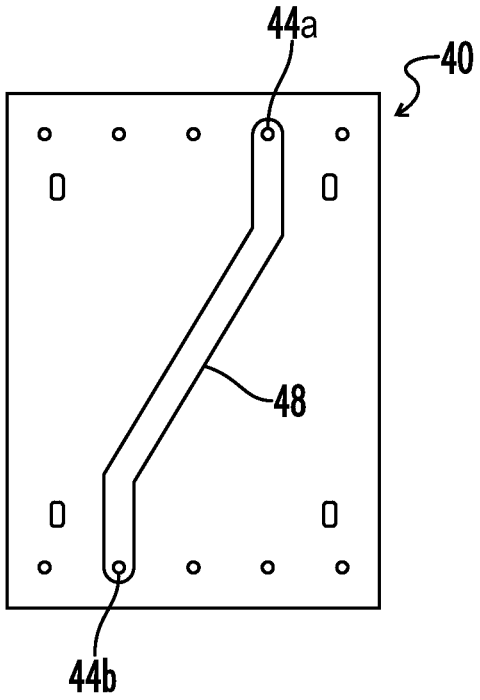
FIG. 9 illustrates a plan view of an embodiment of a component printed circuit board with a crossover trace.

As seen in FIG. 9, a component trace 48 forming a crossover trace is disposed on component printed circuit board 40. Component trace 48 provides an electrical pathway between first and second component vias 44*a*, 44*b* positioned to correspond to terminal pins on opposite bobbin pin rails. As such, when first and second corresponding terminal pins are installed through, and electrically joined to, the first and second component vias 44*a*, 44*b*, an electrical pathway is established between the terminal pins by the component trace 48. Component trace 48 may be formed of any suitable electrical conductor positioned on component printed circuit board 40.

Figure 10:
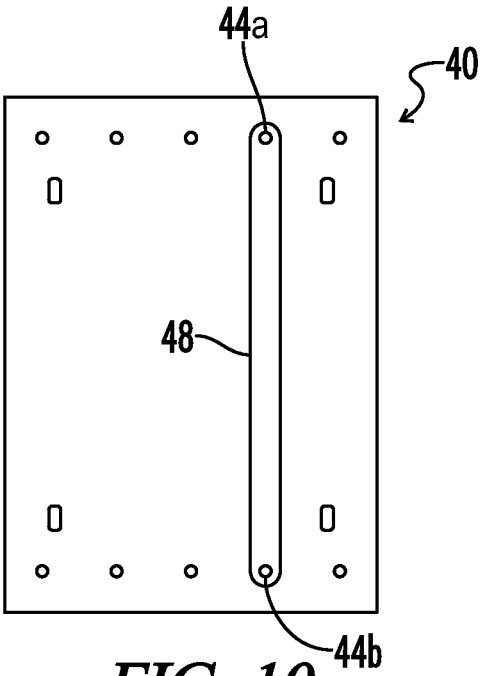
FIG. 10 illustrates a plan view of an embodiment of a component printed circuit board with a crossover trace.
Figure 11:
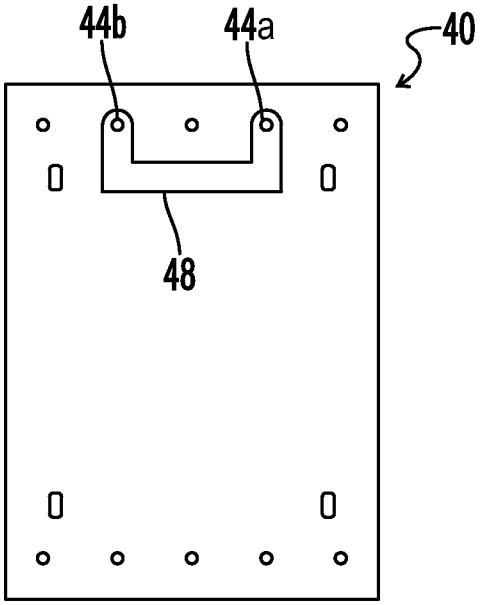
FIG. 11 illustrates a plan view of an embodiment of a component printed circuit board with a jumper trace.
Figure 12:
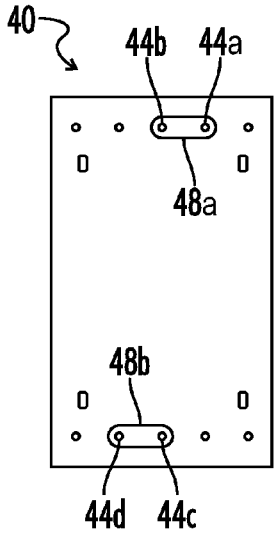
FIG. 12 illustrates a plan view of an embodiment of a component printed circuit board with first and second jumper traces.

As seen in FIG. 9, component trace 48 may interconnect component vias 44*a*, 44*b* that are not directly across from each other. Alternatively, as seen in FIG. 10, in some embodiments, component trace 48 does connect first and second component vias 44*a*, 44*b* directly across from each other on opposite bobbin pin rails. Referring to FIG. 11, in some embodiments, component trace 48 forms a jumper interconnecting first and second component vias 44*a*, 44*b* located on the same side of component printed circuit board 40. The first and second component vias 44*a*, 44*b* seen in FIG. 11 correspond to bobbin terminal pins protruding from the same bobbin pin rail. Additionally, as seen in FIG. 12, in some embodiments, a first component trace 48*a* may interconnect first and second component vias 44*a*, 44*b* located on a first edge of component printed circuit board 40, and a second component trace 48*b* interconnects third and fourth component vias 44*c*, 44*d* located on a second edge of component printed circuit board 40.

Figure 13:
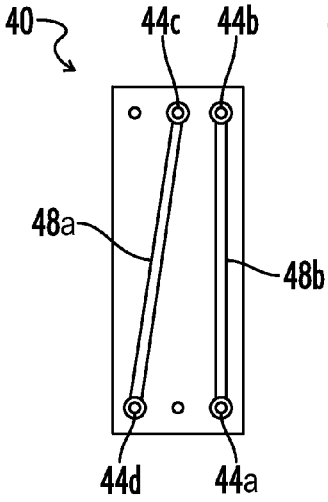
FIG. 13 illustrates a plan view of an embodiment of a component printed circuit board with first and second crossover traces.
Figure 14:
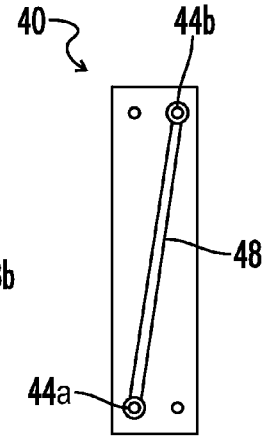
FIG. 14 illustrates a plan view of an embodiment of a component printed circuit board with a crossover trace.
Figure 15:
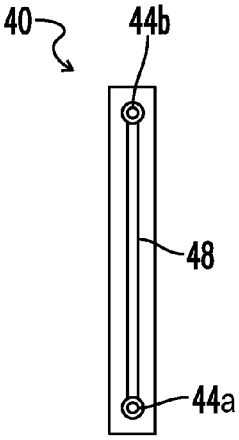
FIG. 15 illustrates a plan view of an embodiment of a component printed circuit board with a crossover trace.

Additionally, as seen in FIGS. 13-15, component printed circuit board 40 may include fewer component vias than terminal pins 22 protruding from bobbin 20. For example, a bobbin 20 may include ten terminal pins as seen in FIG. 5, but component printed circuit board 40 may only have six component vias such that only some of the terminal pins pass through component printed circuit board 40, and the remaining terminal pins extend directly to main printed circuit board 50.

Figure 16:
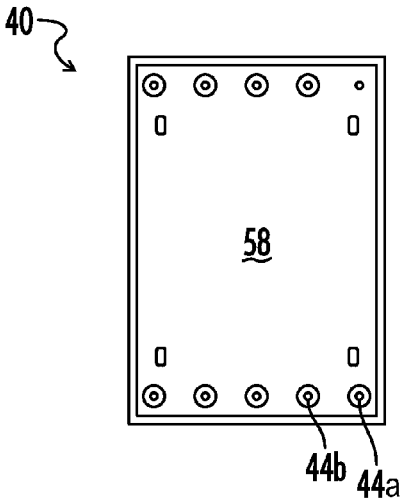
FIG. 16 illustrates a plan view of an embodiment of a component printed circuit board a shielding layer disposed thereon.
Figure 17:
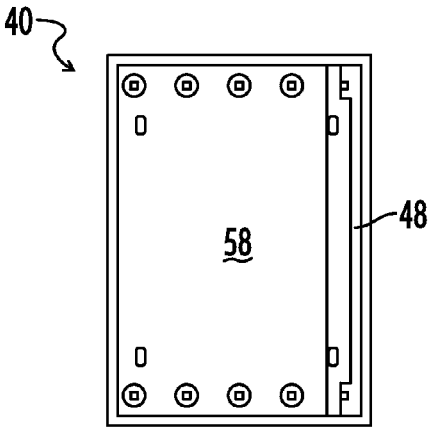
FIG. 17 illustrates a plan view of an embodiment of a component printed circuit board with a grounding connection and a crossover trace.

Referring to FIGS. 16-17, in some embodiments, component printed circuit board 50 includes one or more shielding layers 58 disposed thereon. As such, component printed circuit board 50 provides RF, magnetic or thermal shielding between magnetic component 10 and main circuit board 50. Shielding layer 58 may include any suitable shielding material such as RF, magnetic and/or thermal shielding material. Shielding layer 58 may be a copper sheet in some embodiments. In some embodiments, as seen in FIG. 17, component printed circuit board 40 includes both a shielding layer 58 and a component trace 48 forming a crossover between component vias. Additionally, in some embodiments, multiple component printed circuit boards each having a different shielding or component trace configuration may be installed between bobbin 20 and main printed circuit board 50. Component printed circuit board 40 also includes other circuit components such as resistors, capacitors, inductors, or other suitable circuit components in some embodiments.

Thus, although there have been described particular embodiments of the present invention of new and useful Magnetic Component with Integrated Component Printed Circuit Board, it is not intended that such references be construed as limitations upon the scope of this invention except as set forth in the following claims.

What is claimed is:

1. A magnetic component apparatus for mounting on a main printed circuit board, comprising:

a bobbin comprising at least one winding and first and second bobbin rails;

first and second terminal pins respectively mechanically connected to the first and second bobbin rails, the first and second terminal pins being electrically connected to the at least one winding and being configured to protrude from the bobbin;

a component printed circuit board mounted on the first and second terminal pins and configured to fit between the bobbin and the main printed circuit board; and wherein the first and second terminal pins are configured to each provide electrical connection between the bobbin, the component printed circuit board, and the main printed circuit board, and wherein the magnetic component apparatus is configured to provide a gap between the component printed circuit board and the main printed circuit board.

2. The apparatus of claim 1, further comprising first and second component vias defined through the component printed circuit board.

3. The apparatus of claim 2, wherein the first terminal pin protrudes through the first component via and the second terminal pin protrudes through the second component via.

4. The apparatus of claim 3, further comprising a component trace disposed on the component printed circuit board between the first and second component vias.

5. The apparatus of claim 3, wherein the first and second terminal pins are positioned to engage corresponding first and second main vias defined in the main printed circuit board.

6. The apparatus of claim 5, further comprising a magnetically permeable core disposed on the bobbin.

7. The apparatus of claim 6, wherein the magnetically permeable core comprises first and second E-core halves.

8. The apparatus of claim 5, further comprising a shielding layer disposed on the component printed circuit board.

9. The apparatus of claim 6, further comprising a grounding connector disposed on the component printed circuit board.

10. A magnetic component apparatus for mounting on a main circuit board, comprising:

a bobbin comprising at least one winding and first and second bobbin rails;

first and second terminal pins respectively mechanically connected to the first and second bobbin rails, the first and second terminal pins being electrically connected to the at least one winding and being configured to protrude from the bobbin;

a component printed circuit board disposed on the first and second terminal pins, wherein the first and second terminal pins protrude through the component printed circuit board extending in a direction away from the bobbin, and wherein the magnetic component apparatus is configured to provide a gap between the component printed circuit board and the main circuit board; and a component trace disposed on the component printed circuit board electrically connecting the first and second terminal pins.

11. The apparatus of claim 10, wherein the bobbin further comprises first and second opposing bobbin rails.

12. The apparatus of claim 11, wherein the first terminal pin protrudes from the first bobbin rail, and the second terminal pin protrudes from the second bobbin rail.

13. The apparatus of claim 12, wherein the component trace is a crossover trace electrically connecting the first terminal pin on the first bobbin rail with the second terminal pin on the second bobbin rail.

14. The apparatus of claim 11, wherein the first and second terminal pins both protrude from the first bobbin rail.

15. The apparatus of claim 14, wherein the component trace is a jumper trace connecting the first and second terminal pins both on the first bobbin rail.

16. The apparatus of claim 15, wherein the first and second terminal pins are adjacent.

17. The apparatus of claim 10, further comprising:

a main standoff socket defined in the component printed circuit board; and a main standoff extending from the bobbin and configured to protrude through the main standoff socket.

18. The apparatus of claim 17, wherein the main standoff is configured to rest against the main circuit board.

19. The apparatus of claim 18, further comprising a component standoff extending from the bobbin a distance less than the main standoff extends from the bobbin, wherein the component printed circuit board rests against the component standoff.

20. The apparatus of claim 10, further comprising a shielding layer disposed on the component printed circuit board.

* * * * *